US005906078A

United States Patent [19]

Cramer

[11] Patent Number: 5,906,078

[45] Date of Patent: May 25, 1999

[54] RETAINING STRIP FOR SHEET COVERED ENCLOSURES

[75] Inventor: George O. Cramer, Grosse Pointe Woods, Mich.

[73] Assignee: Gallagher-Kaiser Corporation, Detroit, Mich.

[21] Appl. No.: 08/876,683

[22] Filed: Jun. 17, 1997

Related U.S. Application Data

[63] Continuation-in-part of application No. 08/731,031, Oct. 9, 1996, abandoned.

[51] Int. Cl.[6] ..... E04B 1/12; E04H 15/34

[52] U.S. Cl. ..... 52/222; 52/202; 52/63; 135/97; 135/121; 160/392; 160/395

[58] Field of Search ..... 52/222, 203, 63; 160/380, 392, 395; 24/460, 462; 135/97, 121, 88.12, 88.13

[56] References Cited

U.S. PATENT DOCUMENTS

| | | | |
|---|---|---|---|
| 2,104,473 | 1/1938 | Watson | 24/460 |
| 4,410,027 | 10/1983 | Lucous . | |
| 4,662,038 | 5/1987 | Walker | 160/392 X |
| 4,694,543 | 9/1987 | Conley . | |
| 4,799,299 | 1/1989 | Campbell | 160/395 X |
| 4,860,778 | 8/1989 | Pohl . | |
| 4,947,561 | 8/1990 | Delacroix et al. | 160/392 X |
| 5,224,306 | 7/1993 | Cramer . | |
| 5,577,352 | 11/1996 | Fisher | 160/392 X |

FOREIGN PATENT DOCUMENTS

| | | | |
|---|---|---|---|
| 286318 | 10/1968 | Australia | 52/222 |
| 2201522 | 7/1973 | Germany | 160/395 |

*Primary Examiner*—Carl D. Friedman
*Assistant Examiner*—Winnie S. Yip
*Attorney, Agent, or Firm*—Howard & Howard

[57] ABSTRACT

A clean environment enclosure assembly (10) fabricated of a framework comprising a plurality of struts (18, 118, 218) with a plastic sheet (20) suspended between the struts (18, 118, 218) to define an enclosed space (12). A cap (22, 122, 222) is secured to and extends longitudinally along each of the struts (18, 118, 218), the cap (22, 122, 222) presenting a generally planar outer surface (24, 124, 224) and a groove (26, 126, 226) extending longitudinally there along. The sheet (20) is disposed in the groove (26, 126, 226) and overlays the planar surface (24, 124, 224) of the cap (22, 122, 222). A retainer strip (28, 128, 228) is retained in the groove (26, 126, 226) to sandwich the sheet (20) in the groove (26, 126, 226). The retainer strip (28, 128, 228) has an outer face (30, 130, 230) aligned with the outer surface (24, 124, 224) of the cap (22, 122, 222) to present a continuous smooth outer surface from the cap (22, 122, 222) to the strip (28, 128, 228) whereby the sheet (20) is retained in the groove (26, 126, 226) and presents a surface over the sheet (20) as supported by the cap (22, 122, 222) which is substantially continuous over the strip (28, 128, 228). Three embodiments of the cap (22, 122, 222) and the strip (28, 128, 228) are disclosed.

13 Claims, 2 Drawing Sheets

RETAINING STRIP FOR SHEET COVERED ENCLOSURES

RELATED APPLICATION

This application is a Continuation-In-Part of application Ser. No. 08/731,031 filed Oct. 9, 1996, now is abandoned.

TECHNICAL FIELD

The subject invention relates to enclosures fabricated from interconnected struts with a plastic sheet suspended between the struts to define an enclosed space.

BACKGROUND OF THE INVENTION

Structures for suspending sheets to define environmentally controlled spaces are well known. The U.S. Pat. Nos. 4,860,778 to Pohl and 5,224,306 to Cramer exemplify such structures. These prior art systems employ a U-shaped strut with a sheet retained against the interior of the strut by a cap frictionally held between the legs of the U-shaped strut. Similar retaining devices are disclosed in U.S. Pat. Nos. 4,410,027 to Lucous and 4,694,543 to Conley.

However, all of the prior art devices present a significant projection form the plane of the retained sheet.

SUMMARY OF THE INVENTION AND ADVANTAGES

A clean environment enclosure assembly comprising a framework including a plurality of struts with at least one sheet suspended between the struts to define an enclosed space. A cap is secured to and extends longitudinally along a cap engaging surface of each of the struts. The cap presenting a generally planar outer surface and a groove extending longitudinally there along. The sheet is disposed in the groove and overlays the planar surface of the cap. A retainer strip is retained in the groove to sandwich the sheet in the groove. The retainer strip has an outer face aligned with the outer surface of the cap to present a continuous smooth outer surface from the cap to the strip whereby the sheet is retained in the groove and presents a surface over the sheet as supported by the cap which is substantially continuous over the strip, the groove includes a bottom and side walls with the side walls having irregular shapes for retaining the strip. The strip includes edges which are spaced apart a distance and are complimentary in shape to the irregular shapes of the side walls of the groove. The strip has a thickness which is less than one third the distance between the edges and a center line extending between the edges and spaced above the cap engaging surface of the strut.

Accordingly, the subject invention provides sheet retaining system which does not project from the plane of the retained sheet, which, among other benefits, presents and overall smooth appearance to the enclosure with the retaining strip disposed outside the strut.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
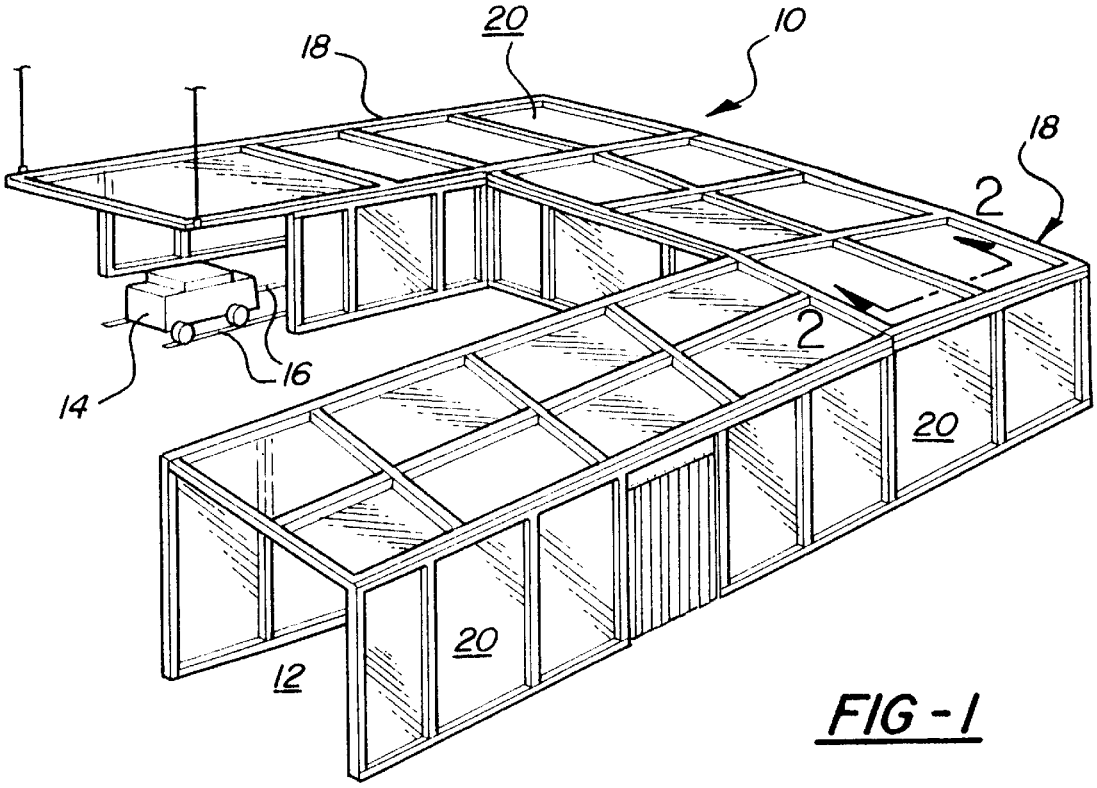
FIG. 1 is a perspective view of an enclosure assembly fabricated in accordance with the subject invention.

Referring to the Figures, wherein like numerals indicate like or corresponding parts throughout the several views, a clean environment enclosure assembly is generally shown at 10. The enclosure 10 prevents contaminants from entering the enclosed space 12. The enclosed space 12 is typically in a manufacturing facility where parts are moved by a cart 14 along tracks 16 through the enclosed space 12.

The assembly 10 comprises a framework including a plurality of interconnected struts 18, each of which presents a cap engaging surface 19. The struts 18 are preferably held together by brackets and fasteners. A plurality of sheets 20 are suspended between the struts 18 to define an enclosure, i.e., the enclosed space 12. The sheets are typically made of plastic, usually transparent to allow viewing into and out of the enclosed space 12.

Figure 2:
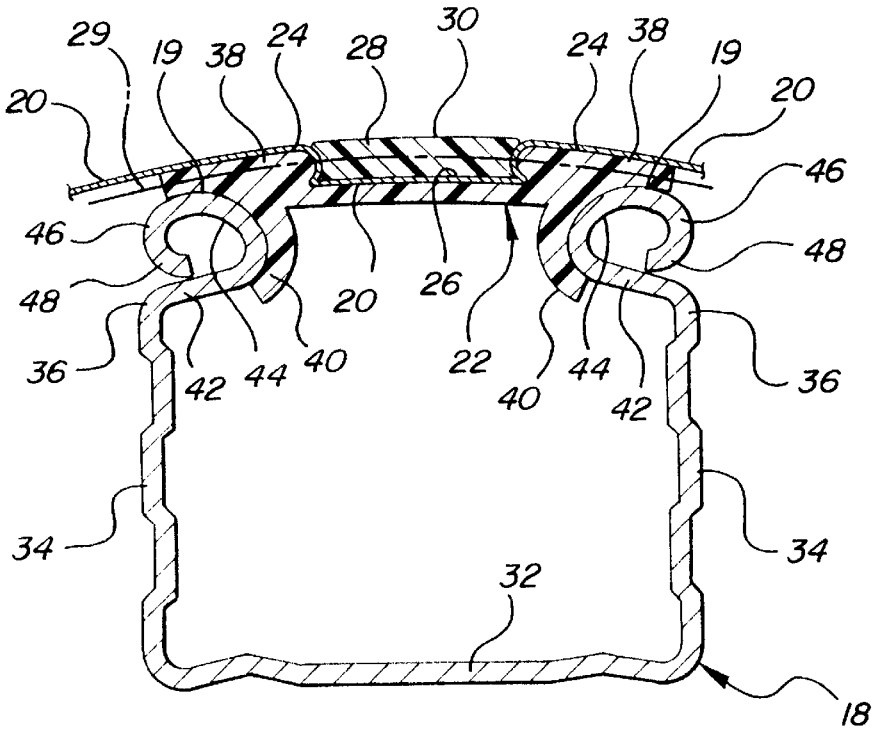
FIG. 2 is a cross sectional view of a first embodiment taken along fine 2—2 of FIG. 1.

In the embodiment of FIG. 2, a cap, generally indicated at 22, is secured to and extending longitudinally along each of the struts 18. The cap 22 presents a generally planar outer surface 24 and a groove 26 extending longitudinally there along. The sheet 20 is disposed in the groove 26 and overlays the planar surfaces 24 on either side of the groove 26. The cap 22 has a bottom surface engaging and overlying the cap engaging surface 19 of the strut 18.

A retainer strip 28 is retained in the groove 26 to sandwich the sheet 20 in the groove 26. The retainer strip 28 has an outer face 30 aligned with the outer surface 24 of the cap 22 to present a continuous smooth outer surface from the cap 22 to the strip 28 whereby the sheet 20 is retained in the groove 26 and presents a surface over the sheet as supported by the cap which is substantially continuous over the strip 28. In other words, when assembled, there is a smooth transition over the sheet 20 on the side surfaces 24 to the upper surface 30 of the strip 28.

The groove 26 includes a bottom and side walls and the side walls having irregular shapes for retaining the strip 28. In a similar fashion, the strip 28 includes edges which are spaced apart a distance and are complementary in shape to the irregular shapes of the side walls of the groove 26. More specifically, the edges of the strip 28 are concave and the side walls of the groove 26 are convex. The strip 28 is also complementary to and substantially fills the groove 26.

Each of the struts 18 comprises a U-shaped channel defined by a base 32 and legs 34 extending to distal ends 36. The cap 22 is retained between the distal ends 36 of the legs 34.

The distal ends 36 of the legs 34 include retaining portions extending inwardly toward one another. The cap 22 includes a top section including flanges 38 which define the bottom surface overlaying cap engaging surface 19, defined by the retaining portions and oppositely, and outwardly facing hook sections 40 depending form the top section and hooked underneath the retaining portions. More specifically, the retaining portions each curl inwardly 42 from the distal end 36 of the associated leg 34 and upwardly 44 and downwardly 46 and into the center 48 thereof. The hook sections 40 are concave to engage the curled retaining portions 42, 44, 46 and 48.

Accordingly, the upper presentation of the assembly is substantially planer, albeit with a slight curvature, as the sheet 20 is suspended over the upper surfaces 24 of the flanges 38 of the cap 22 and under the strip 28 as the strip 28 presents an upper surface 30 which is generally aligned with the adjacent sheet 20.

Figure 3:
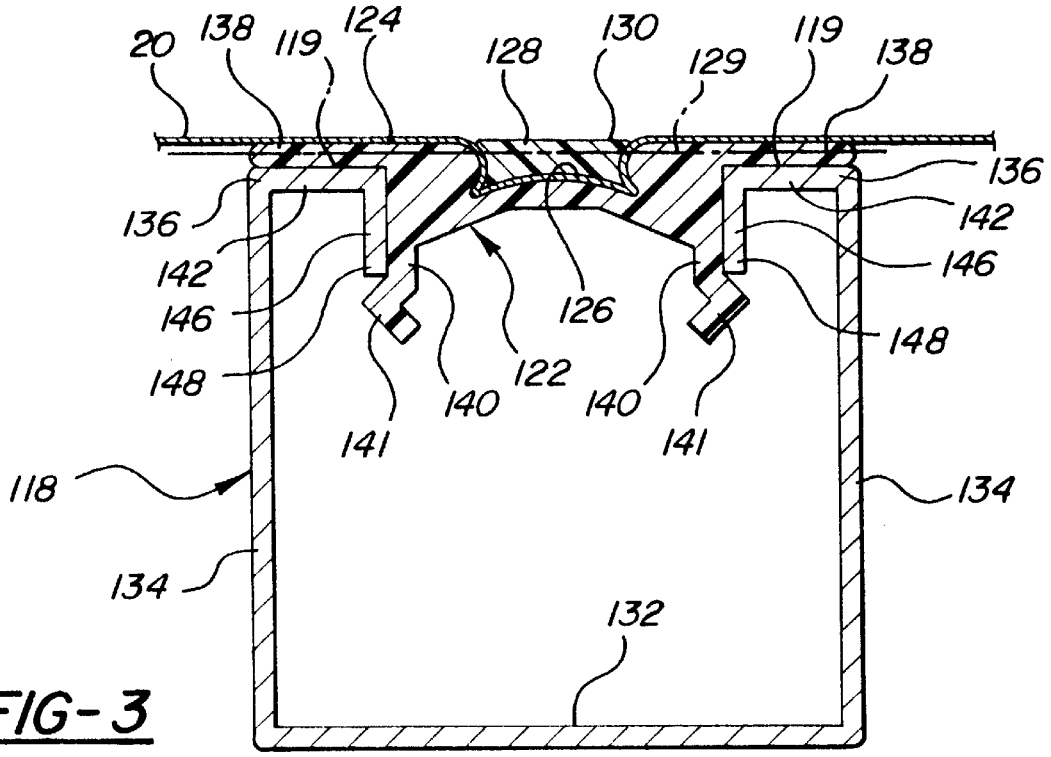
FIG. 3 is a cross sectional view similar to FIG. 2 but showing a second embodiment.

The embodiment of FIG. 3, wherein corresponding elements are indicated with numbers advanced by one hundred, differs from the embodiment of FIG. 1 by the retaining portions each extending inwardly 142 from the distal end 136 of the associated leg 134 and then downwardly 146 to a lip 148. That is, the retaining portion is squared off. In a complementary fashion, the hook sections 140 extend downwardly along the depending section 146 of the retaining portion and into an outwardly projecting ridge 141 disposed underneath the lip 148.

Figure 4:
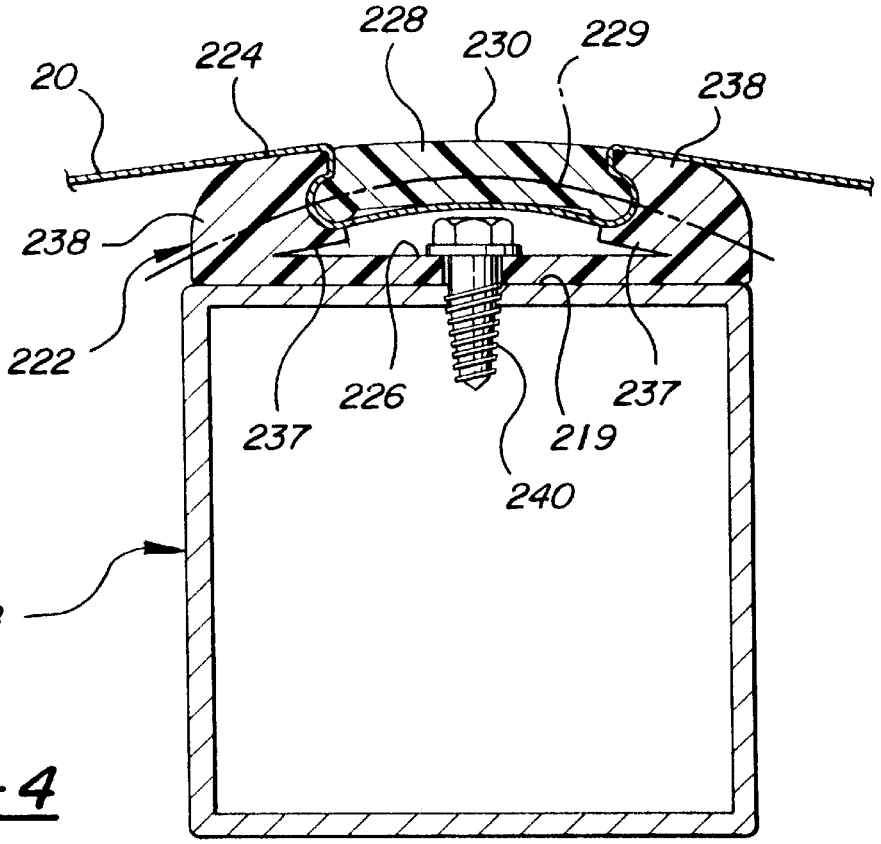
FIG. 4 is a cross sectional view similar to FIG. 2 but showing a third embodiment.

In the embodiment of FIG. 4, wherein corresponding elements are indicated with numbers advanced by two hundred, each of the struts is defined by a four sided tubular channel and fastener means, comprising metal screws 240 retain the cap 222 along one of the sides of the channel. Additionally, the edges of the strip 228 are convex and the side walls of the groove 226 are concave. The groove 226 also provides a cavity under the strip 228 and the fastener screws 240 are disposed in the cavity under the strip 222. The cap 222 is coextensive with the width of the channel. The cap 222 also includes slits 237 extending into the cap 222 from the sides of the cavity to define inwardly extending flanges 238 in the cap 222.

The cap 22, 122, 222 and the strip 28, 128, 228 are made of organic polymeric material, usually extruded. The strip 28, 128, 228 has a thickness from top to bottom which is less than one third the distance between said edges thereof, i.e., the strip is long and narrow as viewed in cross section. Also, each strip 28, 128, 228 has a center line 29, 129, 229 extending between the edges and spaced above the bottoms of the caps 22, 122, 222 and above the cap engaging surfaces 19, 119, 219 of the struts 18. In this configuration, the retention of the strips is independent of the retention of the caps. Accordingly, the centers of the concave and convex edges of the strips are above the bottoms and the cap engaging surfaces 19, 119, 219. The outer edges of the strip are spaced inwardly of the inner extremities of the retainer portions in the embodiments of FIGS. 1 and 2.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A clean environment enclosure assembly (10) comprising:

a framework including a plurality of struts (18, 118, 218), each presenting a cap engaging surface (19, 119, 219), at least one sheet (20) suspended between said struts (18, 118, 218) to define an enclosed space (12), a cap (22, 122, 222) secured to and extending longitudinally along said cap engaging surface (19, 119, 219) of each of said struts (18, 118, 218), said cap (22, 122, 222) presenting a generally planar outer surface (24, 124, 224) and a groove (26, 126, 226) extending longitudinally there along, said sheet (20) disposed in said groove (26, 126, 226) and overlaying said planar surface (24, 124, 224) of said cap (22, 122, 222), a retainer strip (28, 128, 228) retained in said groove (26, 126, 226) to sandwich said sheet (20) in said groove (26, 126, 226), said retainer strip (28, 128, 228) having an outer face (30, 130, 230) aligned with said outer surface (24, 124, 224) of said cap (22, 122, 222) to present a continuous smooth outer surface from said cap (22, 122, 222) to said strip (28, 128, 228), said groove (26, 126, 226) including a bottom and side walls having irregular shapes for retaining said strip (28, 128, 228), said strip (28, 128, 228) including edges which are spaced apart a distance and are complementary in shape to and fills the space between said irregular shapes of said side walls of said grooves (26, 126, 226) and a thickness which is less than one third the distance between said edges, said strip (28, 128, 228) having a center line (29, 129, 229) extending between said edges sand spaced above said cap engaging surface (19, 119, 219) of said strut.

2. An assembly as set forth in claim 1 wherein said edges of said strip (28, 128) are concave and said side walls of said groove (26, 126) are convex with centers above said cap engaging surface (19, 119, 219).

3. An assembly as set forth in claim 1 wherein edges of said strip (228) are convex and side walls of said groove (226) are concave with centers above said cap engaging surface (19, 119, 219).

4. An assembly as set forth in claim 1 wherein each of said struts (18, 118) comprises a U-shaped channel defined by a base (32, 132) and legs (34,134) extending to distal ends (36,135), said cap (22, 122) being retained between said distal ends (36, 136) of said legs (34, 134).

5. An assembly as set forth in claim 4 wherein said distal ends (36, 136) of said legs (34, 134) include retaining portions (42, 44, 46, 48 and 142, 146, 148) extending inwardly toward one another and defining said cap engaging surface (19, 119, 219), said cap including a top section overlaying said retaining portions (42, 44, 46, 48 and 142, 146, 148) and oppositely and outwardly facing hook sections (40, 140) depending form said top section and hooked underneath said retaining portions (42, 44, 46, 48 and 142, 146, 148).

6. An assembly as set forth in claim 2 wherein said retaining portions (42, 44, 46, 48) each curl inwardly (42) from the distal end (36) of said associated leg (34) and upwardly (44) and downwardly (46) and over the first curl inwardly (42).

7. An assembly as set forth in claim 6 wherein said hook sections (40) are concave to engage said curled retaining portions (42, 44,46, 48).

8. An assembly as set forth in claim 5 wherein said retaining portions each extend inwardly (142) from said distal end (136) of said associated leg and then downwardly (146) to a lip (148).

9. An assembly as set forth in claim 8 wherein said hook sections (140) extend downwardly along said retaining portion and underneath said lip (148).

10. An assembly as set forth in claim 1 wherein each of said struts (218) comprises a four sided channel (218), and fastener means (240) retaining said cap (222) along said cap engaging surface of said channel (218).

11. An assembly as set forth in claim 10 wherein said groove (226) provides a cavity under said strip (228) and said fastener means (240) is disposed in said cavity.

12. An assembly as set forth in claim 11 including slits (237) extending into said cap (222) from said cavity to define inwardly extending flanges (238) in said cap (222).

13. A retaining assembly for retaining a sheet (20) suspended between struts (18, 118, 218) to define a clean environment enclosure, said assembly comprising:

a cap (22, 122, 222) for extending longitudinally along each of the struts (18, 118, 218), said cap (22, 122, 222) presenting a generally planar outer surface (24, 124, 224) and a groove (26, 126, 226) extending longitudinally there along for receiving the sheet (20) in said groove (26, 126, 226) as the sheet (20) overlays said planar surface (24, 124, 224), said cap (22, 122, 222) having a bottom surface for overlaying a cap engaging surface (19, 119, 219) of a strut (18, 118, 218), a retainer strip (28, 128, 228) retained in said groove for retaining the sheet (20) in said groove (26, 126, 226), said retainer strip (28, 128, 228) having an outer face (30, 130, 230) aligned with said outer surface (24, 124, 224) of said cap (22, 122, 222) to present a continuous smooth outer surface from said cap (22, 122, 222) to said strip (28, 128, 228), said groove (26, 126, 226) including a bottom and side walls, said side walls having irregular shapes for retaining said strip (28, 128, 228), said strip (28, 128, 228) including edges which are spaced apart a distance and complementary in shape to and fills the space between said irregular shapes of said side walls of said groove (26, 126, 226), said strip (28, 128, 228) having a thickness which is less than one third the distance between said edges, and said strip having a center line (29, 129, 229) extending between said edges and spaced above said bottom surface of said cap for disposition outside the strut.

* * * * *